US006588433B2

(12) United States Patent
Asano

(10) Patent No.: US 6,588,433 B2
(45) Date of Patent: Jul. 8, 2003

(54) HAIR COSMETIC APPLICATOR

(75) Inventor: Tetsuya Asano, Tokyo (JP)

(73) Assignee: Kao Corporation, Tokyo (JP)

( * ) Notice: Subject to any disclaimer, the term of this patent is extended or adjusted under 35 U.S.C. 154(b) by 75 days.

(21) Appl. No.: 09/809,193

(22) Filed: Mar. 16, 2001

(65) Prior Publication Data

US 2001/0029960 A1 Oct. 18, 2001

(30) Foreign Application Priority Data

Apr. 14, 2000 (JP) ..... 2000-114459

(51) Int. Cl.[7] ..... A45D 24/22
(52) U.S. Cl. ..... 132/116
(58) Field of Search ..... 132/112, 116, 132/125, 152, 901; 401/282, 183, 138; 15/104.94, 205.2

(56) References Cited

U.S. PATENT DOCUMENTS 812,241 A * 2/1906 Shubert ..... 132/113
1,667,631 A * 4/1928 Mach ..... 132/113
2,292,494 A * 8/1942 Tupper ..... 132/125
2,589,469 A * 3/1952 Zerbo ..... 132/219
2,646,803 A * 7/1953 Di Zazzo ..... 132/112
2,755,807 A * 7/1956 Jorgenson ..... 132/116
3,295,537 A * 1/1967 Young, Jr. ..... 132/113
4,516,591 A * 5/1985 Hierholzer ..... 132/116
4,566,472 A * 1/1986 Mueller et al. ..... 132/112
4,763,675 A * 8/1988 DeFelice ..... 132/137
5,947,130 A * 9/1999 Musum ..... 132/125

* cited by examiner

*Primary Examiner*—Eduardo C. Robert
*Assistant Examiner*—David C. Comstock
(74) *Attorney, Agent, or Firm*—Oblon, Spivak, McClelland, Maier & Neustadt, P.C.

(57) ABSTRACT

A hair cosmetic applicator includes a container for accommodating a hair cosmetic, and a comb section for discharging the hair cosmetic that is inside the container. The comb section is configured by aligning a plurality of plate-form comb teeth having liquid passageways for the hair cosmetic formed in the interiors thereof in the thickness direction of those plate-form comb teeth, discharge holes for the hair cosmetic are provided in at least one side of opposing surfaces of the adjacent plate-form comb teeth, and an inclined surface is formed in the base part of the plate-form comb teeth between adjacent plate-form comb teeth so as to face toward the hair cosmetic application surface when the hair cosmetic is being applied.

10 Claims, 5 Drawing Sheets

Fig. 1
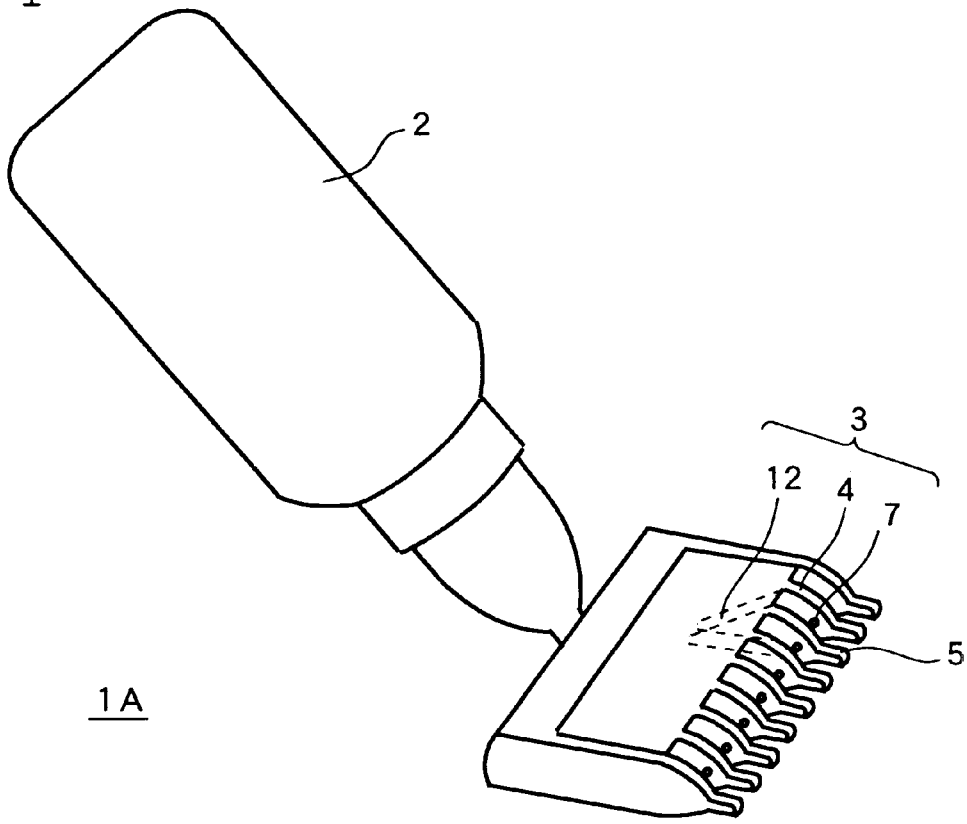
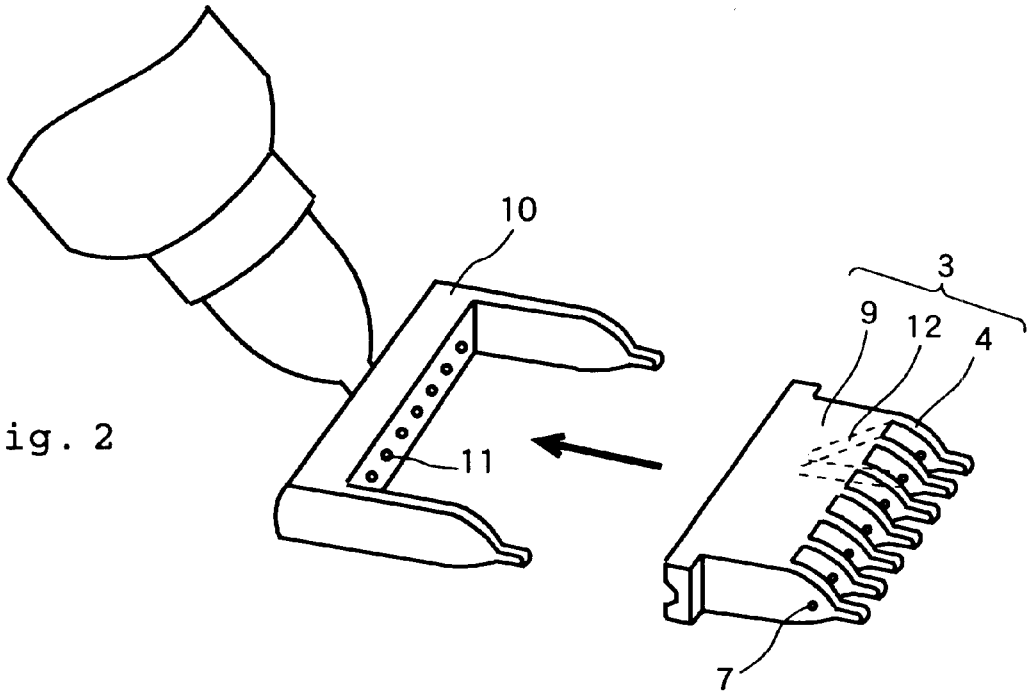
Fig. 2

HAIR COSMETIC APPLICATOR

BACKGROUND OF THE INVENTION

1. Field of the Invention

This invention relates to a hair cosmetic applicator that is an applicator for such hair cosmetics as haircolors and styling agents, wherein integrated are a container for accommodating the hair cosmetic and a comb section for applying the hair cosmetic.

2. Description of the Related Art

Known to the prior art is an applicator for applying a hair cosmetic such as a haircolor (permanent haircolor, semi-permanent haircolor, demi-permanent haircolor, temporary haircolor, etc.) or styling agent to the hair that is, as shown in FIG. 7, a hair cosmetic applicator 1 wherein a squeeze container 2 for accommodating the hair cosmetic and a comb section 3 for applying the hair cosmetic are integrated.

In the comb section 3 of this hair cosmetic applicator 1, a plurality of plate-shaped comb teeth 4 having projecting parts 5 in the tips thereof, are aligned in the thickness direction of those plate-form comb teeth 4. FIGS. 8A and 8B, respectively, are a partial top view and a side view of the comb section 3. As shown in FIGS. 8A and 8B, liquid passageways 6 for the hair cosmetic are formed in the interiors of the plate-form comb teeth 4, and, in the opposing surfaces of adjacent plate-form comb, the open ends of the liquid passageways 6 are provided as discharge holes 7 for the hair cosmetic. The base parts 9 of adjacent plate-form comb teeth 4 are continuous with each other.

As shown in FIG. 9, one end of the base part 9 of the plate-form comb teeth 4 fits into a connecting member 10 so that it can be freely attached or detached. As shown in FIG. 7, moreover, the end part 10*a* of the connecting member 10 on the opposite side from the plate-form comb teeth 4 screws into an opening 2*a* in the squeeze container 2. Inside the connecting member 10 is formed a plurality of branched liquid passageways (not shown) for conducting the hair cosmetic discharged from the opening 2*a* of the squeeze container 2 to the liquid passageways 6 inside the plate-form comb teeth 4, and openings 11 of those liquid passageways connect to openings 8 on the base part 9 side of the liquid passageways 6 inside the plate-form comb teeth 4.

When this hair cosmetic applicator 1 is used in applying a hair cosmetic to hair, first, the comb section 3 is placed against the surface to which the hair cosmetic is to be applied (in other words, against to the scalp), with the squeeze container 2 oriented upward, and the hair cosmetic applicator 1 is moved in the direction indicated by the arrow A in FIG. 10 so as to comb the hair H while pressing the squeeze container 2 and causing the hair cosmetic to be discharged from the discharge holes 7. Thus, when applying the hair cosmetic, it is not necessary to prepare a comb or brush or the like, separately from that hair cosmetic, whereupon the hair cosmetic can be applied to the hair conveniently.

However, when the hair cosmetic is applied using the hair cosmetic applicator 1 described above, as shown in FIG. 10, by moving the hair cosmetic applicator 1 in the direction of arrow A, the hair cosmetic X discharged from the discharge holes 7 is pushed by the side surface 9*a* of the base part 9, and is pushed upward as indicated by the arrow B. For that reason, a problem arises in that the hair cosmetic X cannot be thoroughly applied up to the roots of the hair H. When one tries to dye the gray hair different color using a haircolor for gray hair as the hair cosmetic X.

SUMMARY OF THE INVENTION

To deal with such problems as this, an object of the present invention is to allow a hair cosmetic applicator comprising a container for accommodating a hair cosmetic and a comb section for discharging the hair cosmetic from the container to apply the hair cosmetic surely up to the hair roots and hairline.

In order to attain the object stated above, the inventor found that it is effective, when applying the hair cosmetic X to the hair H using the hair cosmetic applicator 1, as in FIG. 10, to direct the flow of the hair cosmetic X so that it is pushed toward the application surface S, after the hair cosmetic X discharged from the discharge holes 7 is pushed by the side surface 9*a* of the base part 9, and discovered that, for that purpose, it is only necessary to form the side surface 9*a* as an inclined surface facing toward the application surface S.

Specifically, the present invention provides a hair cosmetic applicator that comprises: a container for accommodating a hair cosmetic; and a comb section for discharging the hair cosmetic inside the container; wherein: the comb section is formed by aligning a plurality of plate-form comb teeth in the direction of the thickness of those plate-form teeth; the plate-form comb teeth have liquid passageways for the hair cosmetic in the interiors thereof; discharge hole(s) for hair cosmetic is(are) provided in at least one side of opposing surfaces of adjacent plate-form comb teeth; and an inclined surface is formed in the base part of the plate-form comb teeth between adjacent plate-form comb teeth such that the inclined surface faces toward the side of the surface to be applied when the hair cosmetic is being applied with the hair cosmetic applicator.

BRIEF DESCRIPTION OF THE DRAWINGS

FIG. 1 is a perspective view of the hair cosmetic applicator of the present invention;

FIG. 2 is a diagram illustrating how the comb section and connecting member are mated;

DESCRIPTION OF THE PREFERRED EMBODIMENTS

Figure 3A:
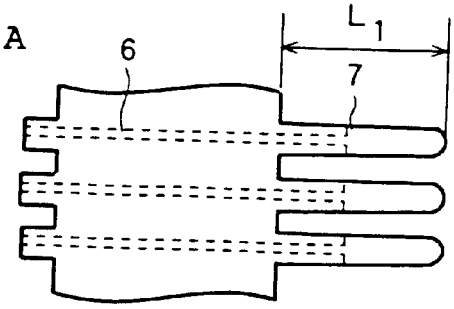
FIGS. 3A, 3B, 3C, and 3D, respectively, are a partial top view, a side view, a bottom view, and a front view of the comb section.
Figure 3B:
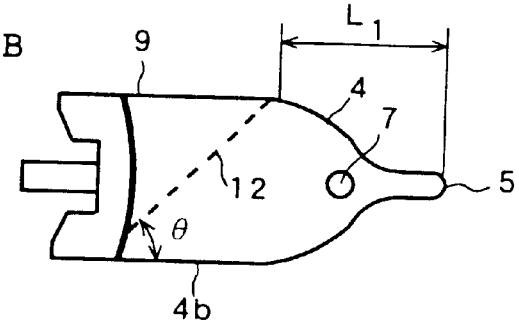
Figure 3D:
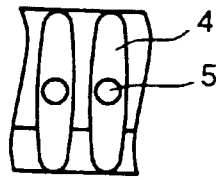
Figure 3C:
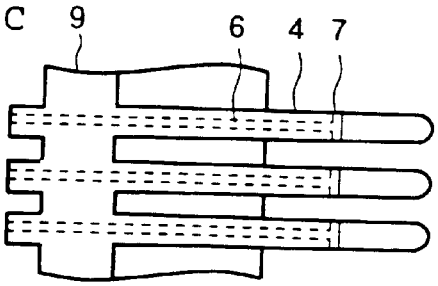

A detailed description of the present invention is now given, making reference to the drawings. In the drawings, identical symbols designate identical or similar configurational elements.

FIG. 1 is a perspective view of a hair cosmetic applicator 1A in one embodiment of the present invention. This hair cosmetic applicator 1A comprises a squeeze container 2 for accommodating the hair cosmetic, and a comb section 3 for applying the hair cosmetic, where, in the comb section 3, a plurality of plate-form comb teeth 4 having projecting parts 5 in the tips thereof are aligned in the thickness direction of those plate-form comb teeth 4, similarly to the conventional hair cosmetic applicator 1 shown in FIGS. 7, 8A, 8B, and 9.

The comb section 3 is configured such that one end of the base part 9 of the plate-form comb teeth 4 fits into a connecting member 10 that can be freely attached and detached (cf. FIG. 2), where liquid passageways 6 for the hair cosmetic are formed in the interiors of the plate-form comb teeth 4, and discharge holes 7 that are the open ends of those liquid passageways 6 are provided in at least one side of opposing surfaces of the adjacent plate-form comb teeth 4 that face each other (cf. FIG. 3).

In the present invention, furthermore, by a plate-form comb tooth is meant a flat plate-shaped comb tooth the area whereof is sufficiently large compared to the thickness thereof.

Figure 4:
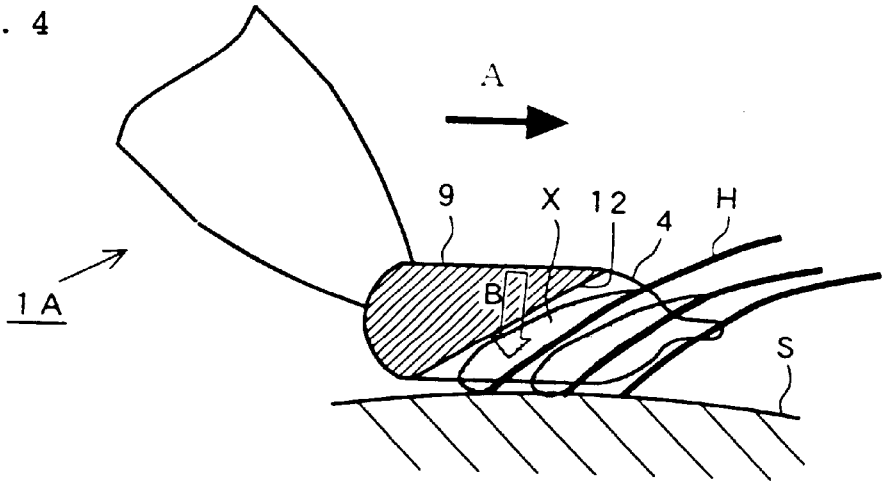
FIG. 4 is a diagram illustrating the action of the hair cosmetic applicator of the present invention.

This hair cosmetic applicator 1A is characterized in that, as shown in FIGS. 1, 2, and 3A to 3D, an inclined surface 12 facing toward the application surface S when the hair cosmetic X is being applied is formed between adjacent plate-form comb teeth 4 in the base part 9 of the plate-form comb teeth 4. Accordingly, as shown in FIG. 4, when this hair cosmetic applicator 1A is being used to apply the hair cosmetic X to the hair H, when the hair cosmetic applicator 1A is moved in the direction of arrow A, the hair cosmetic X discharged from the discharge holes 7 is pushed toward the application surface S, as indicated by arrow B, by the inclined surface 12 in the base part 9 of the plate-form comb teeth 4, and is directed toward the roots of the hair H. Accordingly, based on this hair cosmetic applicator 1A, it is possible to apply the hair cosmetic X effectively up to the roots of the hair.

The angle of inclination θ of the inclined surface here, as shown in FIGS. 3A to 3D, which is the angle formed between the inclined surface 12 and the lower surface 4*b* of the plate-form comb teeth 4 (that is, the angle formed between the inclined surface 12 and the application surface S during the application of the hair cosmetic X), should be preferably from 20° to 70°, and more preferably from 30° to 60°. If the angle of inclination θ is too large, it becomes very difficult to direct the flow of the hair cosmetic in the direction of the application surface S when applying the hair cosmetic. Conversely, if the angle of inclination θ is too small, the comb tooth length $L_1$ (cf. FIG. 3A) of the plate-form comb teeth 4 will become short on the upper surface of the comb section 3, making it difficult to comb the hair with the plate-form comb teeth 4.

The projecting parts 5 at the tips of the plate-form comb teeth 4 are provided to make it easier to comb through the hair, but the discharge holes 7 for the hair cosmetic should be deployed near the projecting parts 5 for applying the hair cosmetic to the hairline, and to the short hair at the temples and around the ears, and also in order to facilitate application to the roots of the hair.

The container 2 for accommodating the hair cosmetic should be inclined preferably at an angle of 0° to 90°, and more preferably at 30° to 60°, with respect to the lower surface 4*b* of the plate-form comb teeth 4. By inclining the container 2 in this way, the hair cosmetic can be applied without interference from the container 2, even when the hair cosmetic applicator is used such that the plate-form comb teeth 4 are pressed firmly against the application surface S.

Figure 5A:
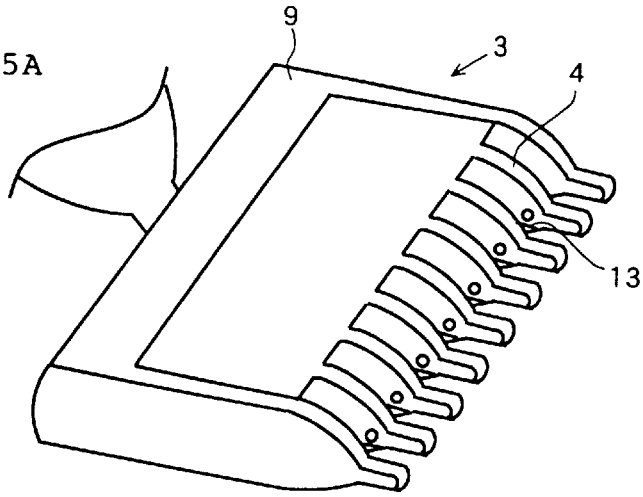
FIGS. 5A, 5B, and 5C, respectively, are a perspective view, a side view, and a front view of the comb section.
Figure 5B:
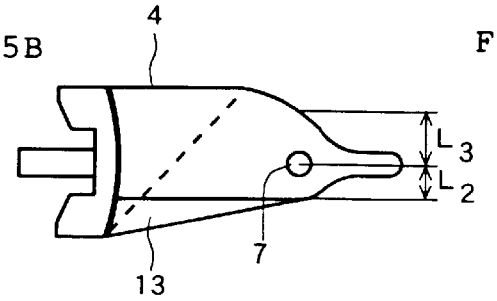
Figure 5C:
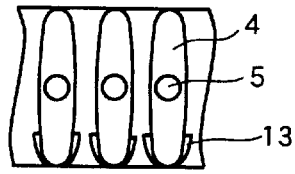

FIGS. 5A, 5B, and 5C, respectively, are a perspective view, a side view, and a front view of the comb section 3 of the hair cosmetic applicator 1B in a different embodiment of the present invention. This hair cosmetic applicator 1B differs from the hair cosmetic applicator 1A of the present invention described above in that rims 13 are provided, with a step, at the edges of the plate-form comb teeth 4 on the side toward the application surface S when hair cosmetic is being applied, and in that the distance $L_2$ from the discharge hole 7 for the hair cosmetic to the edge side of each plate-form comb tooth 4 toward the hair cosmetic application surface S when the hair cosmetic is being applied is shorter than the distance $L_3$ to the other side of the plate-form comb tooth opposing that edge side (that is, the discharge holes 7 are made closer to the edge side of the plate-form comb teeth 4 on the side toward the hair cosmetic application surface S).

By providing the rims 13 in this manner, the holding of the hair cosmetic X between adjacent plate-form comb teeth 4 when the hair cosmetic is being applied is facilitated. Accordingly, excessive hair cosmetic X is prevented from flowing to the application surface S. Thus, when a haircolor is used as the hair cosmetic, for example, the skin is prevented from being unnecessarily dyed.

By making the discharge holes 7 closer to the edge sides of the plate-form comb teeth 4 on the side toward the application surface S, moreover, it becomes possible to cause the hair cosmetic to be applied more thoroughly to the roots.

Figure 6A:
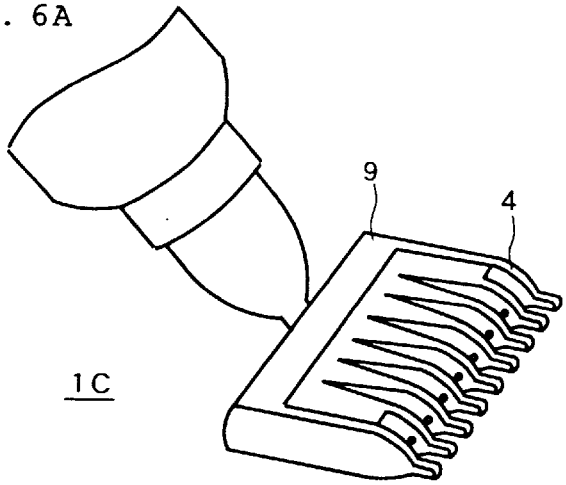
FIGS. 6A, 6B, and 6C, respectively, are a perspective view, a partial enlarged view, and a front view of the comb section.
Figure 6B:
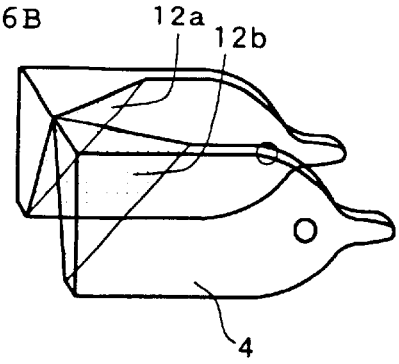
Figure 6C:
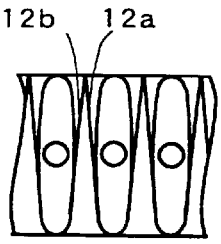
Figure 7:
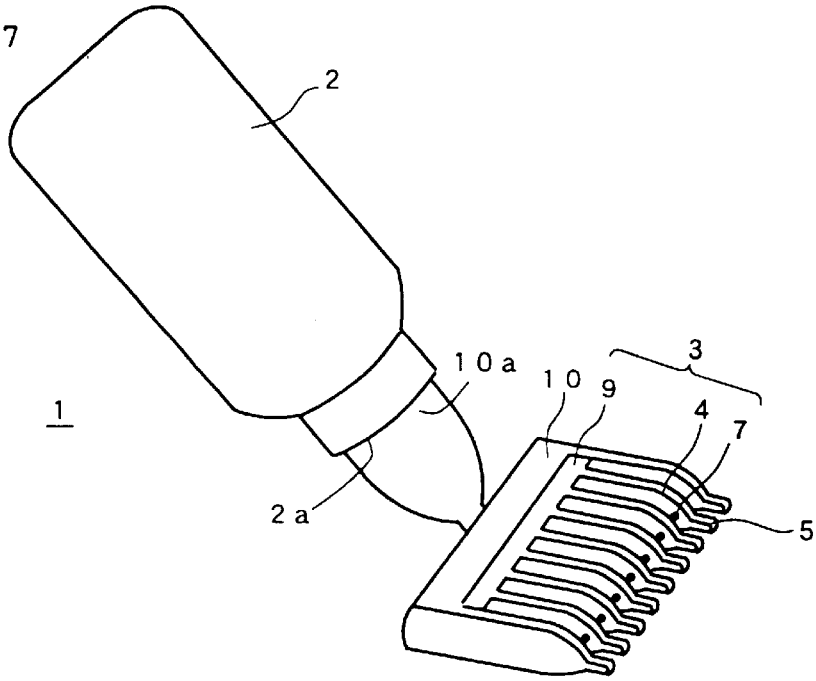
FIG. 7 is a perspective view of a conventional hair cosmetic applicator.
Figure 8A:
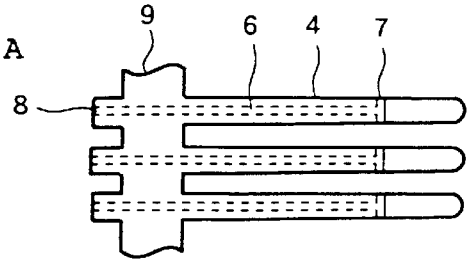
FIGS. 8A and 8B, respectively, are a partial top view and a side view of the comb section.
Figure 8B:
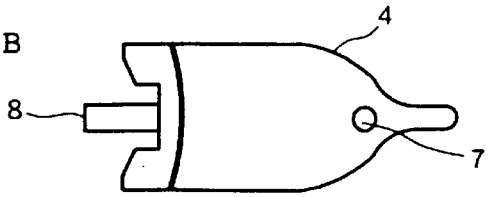
Figure 9:
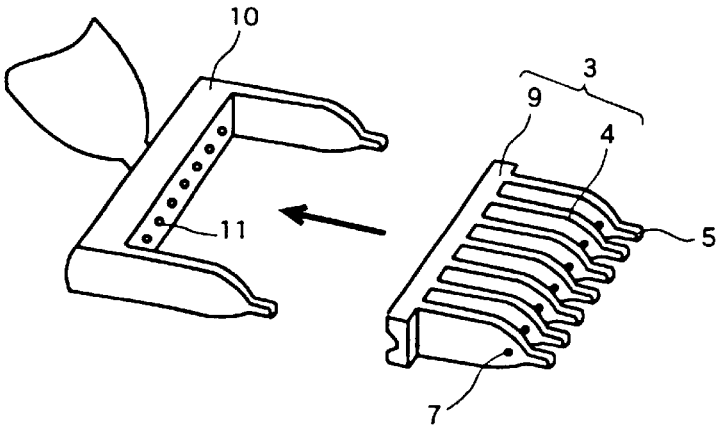
FIG. 9 is a diagram illustrating how the comb section and connecting member mate.
Figure 10:
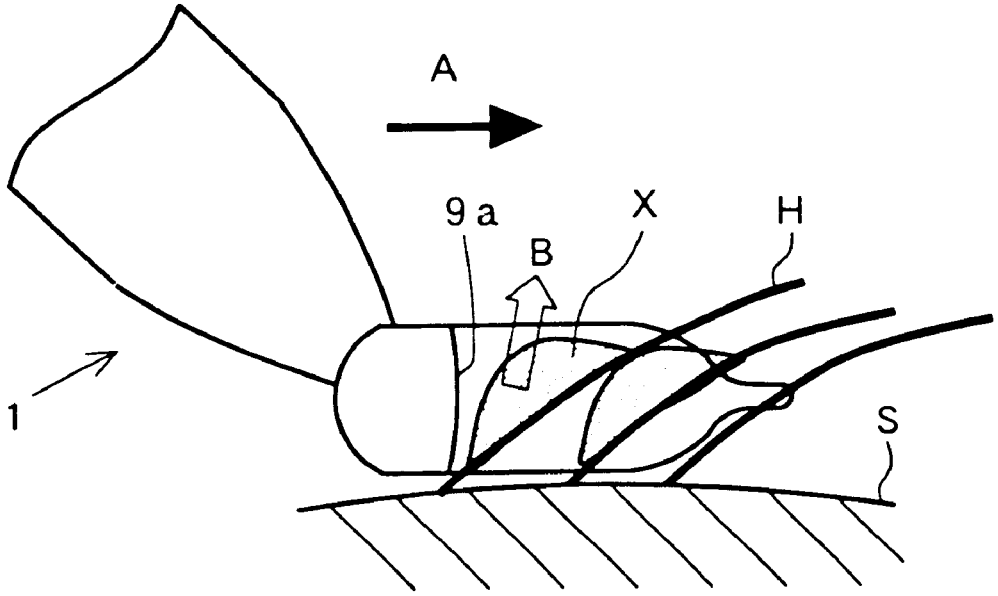
FIG. 10 is a diagram for describing the action of a conventional hair cosmetic applicator.

FIGS. 6A, 6B, and 6C, respectively, are a perspective view, a partial enlarged view, and a front view of the comb section 3 of yet another hair cosmetic applicator 1C of the present invention. In this hair cosmetic applicator 1C, in the upper surface of the base part 9 of the plate-form comb teeth 4 (that is, in the surface on the opposite side from the application surface), V-shaped cuts are made between adjacent plate-form comb teeth 4, and two inclined surfaces 12*a* and 12*b* are formed between adjacent plate-form comb teeth 4. When this is done, the ease of combing, when combing the hair with this comb section 3, can be greatly improved.

The present invention can have in various embodiments, in addition to the embodiments shown in the foregoing, so long as inclined surfaces that face toward the hair cosmetic application surface side when the hair cosmetic is being applied are formed between adjacent plate-form comb teeth in the base part of the plate-form comb teeth. For example, in the upper surface of the base part 9 of the plate-form comb teeth 4 of the hair cosmetic applicator 1B shown in FIGS. 5A to 5C, V-shaped cuts may be made between adjacent plate-form comb teeth 4, and two inclined surfaces (12*a* and 12*b*) formed between adjacent plate-form comb teeth 4, as shown in FIGS. 6A to 6C.

In all of the embodiments shown, moreover, the discharge holes 7 are provided on opposing surfaces of adjacent plate-form comb teeth 4, near the projecting parts 5, but, so long as the hair cosmetic is held between the plate-form comb teeth 4, there is no limitation either on the method of discharge of the hair cosmetic from the container 2, or on the positions where the discharge holes 7 are formed. The discharge holes 7 may be provided in the base bottom part of the plate-form comb teeth 4. In this case, grooves may be formed in the side surfaces of the plate-form comb teeth 4, and the hair cosmetic conducted to the projecting parts 5 of the plate-form comb teeth 4 through those grooves.

The type of hair cosmetic applied using the hair cosmetic applicator of the present invention is not particularly limited, so long as it is a liquid cosmetic of such viscosity that it can pass through the liquid passageways and be discharged from the discharge holes. The hair cosmetic applicator of the present invention can be used to apply various kinds of permanent haircolor, semi-permanent haircolor, demi-permanent haircolor, temporary haircolor, and other haircolors or styling agents or the like to the hair.

Based on the present invention, it becomes possible, with a hair cosmetic applicator comprising a container for accommodating a hair cosmetic, and a comb section for discharging the hair cosmetic that is in the container, to apply the hair cosmetic surely up to the roots of the hair and to the hairline.

The entire disclosure of the specification, summary, claims, and drawings of Japanese Patent Application No. 2000-114459 is hereby incorporated by reference.

What is claimed is:

1. A hair cosmetic applicator, comprising:

a container configured to accommodate a hair cosmetic therein; and a comb section configured to discharge said hair cosmetic in said container, said comb section comprising:

plate-form comb teeth including a first plate-form comb tooth and a second plate-form comb tooth configured to discharge the hair cosmetic, the first plate-form comb tooth having a first bottom surface, a first top surface opposite the first bottom surface, and a first base part, and the second plate-form comb tooth having a second bottom surface, a second top surface opposite the second bottom surface, and a second base part, the bottom surfaces configured to contact a surface for receiving the hair cosmetic, and the plate-form comb teeth connected with one another via the base parts; and an inclined surface formed between adjacent plate-form comb teeth extending from the bottom surfaces to the top surfaces and facing toward the bottom surfaces.

2. The hair cosmetic applicator according to claim 1, wherein said plate-form comb teeth further comprise liquid passageways for said hair cosmetic in interiors thereof terminating in discharge holes configured to discharge the hair cosmetic, the discharge holes disposed in side surfaces extending between the bottom surfaces and the top surfaces.

3. The hair cosmetic applicator according to claim 2, wherein distances from the top surfaces to said discharge holes are greater than distances from the bottom surfaces to the discharge holes.

4. The hair cosmetic applicator according to claim 3, wherein the base portions include V-shaped cuts between the adjacent plate-form comb teeth adjacent the top surfaces.

5. The hair cosmetic applicator according to claim 2, wherein the plate-form comb teeth further comprise projecting parts disposed opposite the base portions, and distances from the base parts to the discharge holes are greater than distances from the projecting parts to the discharge holes.

6. The hair cosmetic applicator according to claim 2, wherein the plate-form comb teeth further comprise rims disposed in the side surfaces.

7. The hair cosmetic applicator according to claim 2, wherein the base portions include V-shaped cuts between the adjacent plate-form comb teeth adjacent the top surfaces.

8. The hair cosmetic applicator according to claim 1, wherein the plate-form comb teeth further comprise rims disposed in side surfaces extending between the bottom surfaces and the top surfaces and adjacent the bottom surfaces.

9. The hair cosmetic applicator according to claim 8, wherein the base portions include V-shaped cuts between the adjacent plate-form comb teeth adjacent the top surfaces.

10. The hair cosmetic applicator according to claim 1, wherein the base portions include V-shaped cuts between the adjacent plate-form comb teeth adjacent the top surfaces.

* * * * *